US006065257A

United States Patent [19]

Nacey et al.

[11] Patent Number: 6,065,257

[45] Date of Patent: May 23, 2000

[54] TENDON ALIGNMENT ASSEMBLY AND METHOD FOR EXTERNALLY REINFORCING A LOAD BEARING BEAM

[75] Inventors: Richard B. Nacey, Harper Woods; Eldon E. Adams, Waterford, both of Mich.

[73] Assignee: Hubbell, Roth & Clark, Inc., Bloomfield Hills, Mich.

[21] Appl. No.: 09/317,342

[22] Filed: May 24, 1999

[51] Int. Cl.[7] ..... E04C 3/10

[52] U.S. Cl. ..... 52/223.8; 52/223.1; 52/223.14; 52/741.1; 14/73

[58] Field of Search ..... 52/223.1, 223.8, 52/223.12, 223.14, 167.4, 167.9, 741.1; 404/70; 14/73, 74.5, 77.1

[56] References Cited

U.S. PATENT DOCUMENTS

| | | | |
|---|---|---|---|
| 1,594,505 | 8/1926 | Frye | 52/223.8 X |
| 2,155,121 | 4/1939 | Finsterwalder | 52/223.8 X |
| 2,675,695 | 4/1954 | Coff . | |
| 3,398,498 | 8/1968 | Krauss | 52/223.8 X |
| 3,427,811 | 2/1969 | White | 52/223.1 X |
| 3,794,433 | 2/1974 | Schupack . | |
| 4,006,523 | 2/1977 | Mauquoy | 52/223.12 X |
| 4,373,837 | 2/1983 | Lin et al. . | |
| 4,393,637 | 7/1983 | Mosier | 52/223.8 X |
| 4,644,714 | 2/1987 | Zayas | 52/167.9 X |
| 4,704,754 | 11/1987 | Bonasso . | |
| 5,597,239 | 1/1997 | Scaramuzza et al. | 52/167.4 X |
| 5,671,572 | 9/1997 | Siller-Franco . | |
| 5,675,943 | 10/1997 | Southworth . | |

FOREIGN PATENT DOCUMENTS

| | | | |
|---|---|---|---|
| 1622-552 | 1/1991 | U.S.S.R. | 52/223.8 |

OTHER PUBLICATIONS

Tokyo Rope Test Procedure. Mar. 1998 pp. 1–15.

*Primary Examiner*—Beth A. Stephan
*Assistant Examiner*—Brian E. Glessner
*Attorney, Agent, or Firm*—Brooks & Kushman P.C.

[57] ABSTRACT

A tendon alignment assembly (20) and method for aligning and providing a bearing surface for externally exposed tendons (10) below a weight bearing structure comprises a tendon slide plate (30) rigidly fixed to the underside of a structure and a tendon alignment shoe (50) in sliding and rotational engagement to the tendon slide plate. The bottom surface (52) of the tendon alignment shoe (50) defines a cavity (54) for receiving a tendon (10). The assembly provides for automatic alignment of the tendons regardless of the skew of the bridge relative to the bridge supports and also for movement caused by dynamic and thermal loading.

17 Claims, 3 Drawing Sheets

Fig. 4
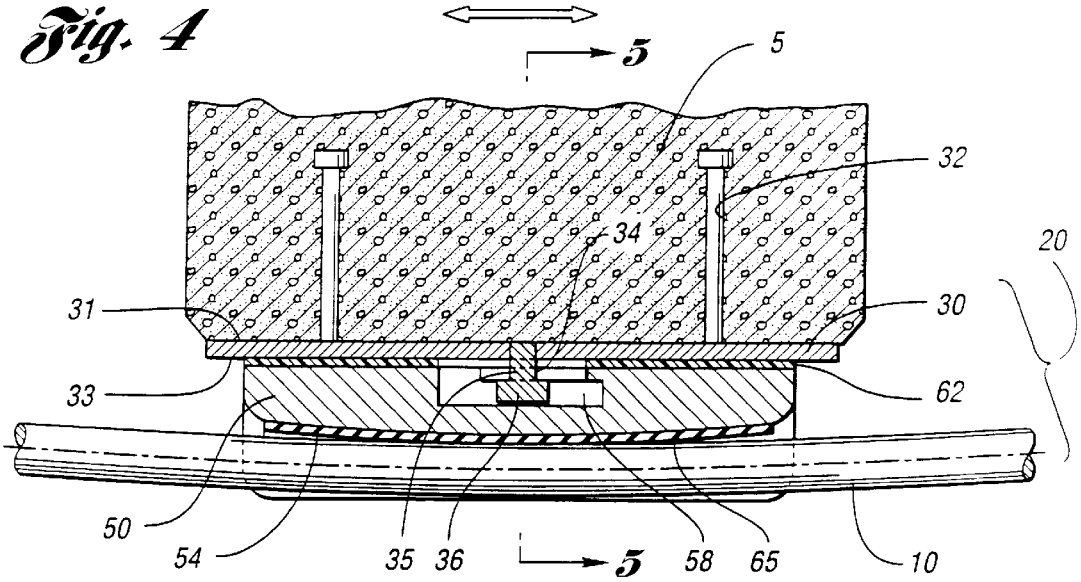
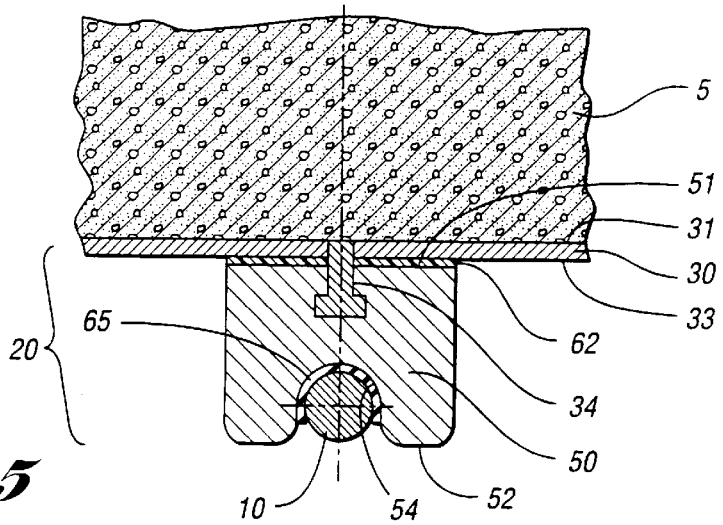
Fig. 5
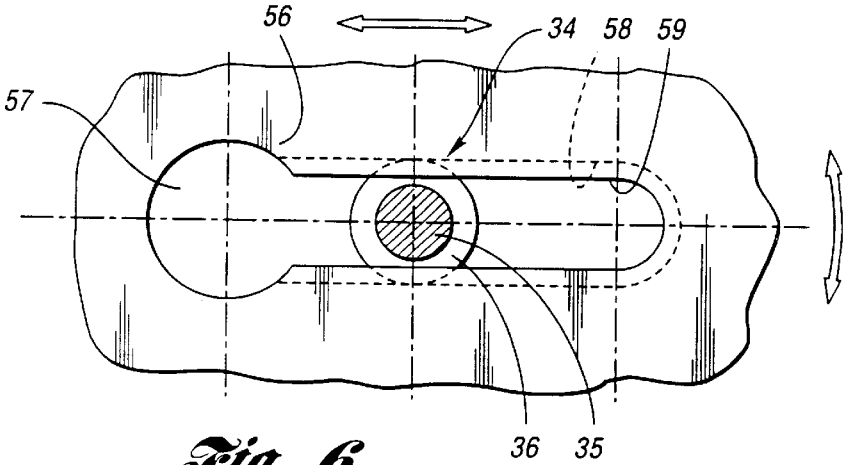
Fig. 6

TENDON ALIGNMENT ASSEMBLY AND METHOD FOR EXTERNALLY REINFORCING A LOAD BEARING BEAM

TECHNICAL FIELD

This invention relates to an assembly and method for aligning and providing a bearing surface for post-tensioned tendons deployed along the underside of a bridge or beam.

BACKGROUND ART

Tension arch bridges comprising of end supports, cables or tendons, and roadway deck elements, as described in U.S. Pat. No. 4,704,754 issued to Bonasso, have been known and used for many years. The bridge supports transmit longitudinal and vertical forces to the ground. A cable is deployed in a predetermined catenary shape with its ends fixed proximate the ends of the bridge. Vertical forces on the bridge cause the bridge to flex downward, thereby tensioning the cable which increases the weight bearing ability of the structure. The bottom of the deck elements contain a plurality of open slots in which the cable passes and transmits its vertical force.

While providing benefits over conventional bridges, the tension arch bridge described in the '754 patent does not address all problems associated with a bridge having a cable deployed underneath it. The slots on the bottom of the deck elements are in a fixed position and cannot automatically align to accommodate dynamic loading of the bridge or construction irregularities of the deck elements or the bridge construction in general. Since the slots are fixed relative to the deck elements, each possible skew of the deck elements relative to the supports requires a different slot angle and thus a different deck element design.

The disclosed design of the '754 patent cannot be modified for use on existing bridge structures. The bridge must be initially designed to incorporate cables.

Further, the cable wears and rubs directly on the surface of the slot, substantially increasing the wear and stress on the cable, thereby decreasing its useful life. Another disadvantage of the tension arch bridge disclosed in the '754 patent is that the cable concentrates its vertical support force on a relatively small area on the bottom of the deck element, roughly the diameter of the cable, creating a high stress area on the deck element itself. If the high stress causes a failure in the deck element, the whole deck element must be replaced.

DISCLOSURE OF INVENTION

Accordingly, it is a principal object of the present invention to provide a tendon alignment assembly for aligning and providing a bearing surface for externally exposed tendons below a weight bearing structure. The assembly comprises a tendon slide plate having a top and bottom surface wherein the top surface of the tendon slide plate is rigidly fixed to the underside of the structure. The assembly also comprises a tendon alignment shoe having a bottom and top surface, the top surface being in sliding and rotational engagement with the bottom surface of the tendon slide plate. The bottom surface of the tendon alignment shoe defines a cavity for receiving a tendon.

A guide pin may extend from the bottom of the tendon slide plate and the top of the tendon alignment shoe may further define a slot on its upper surface to receive the guide pin. The guide pin allows the tendon alignment shoe to rotate about the axis of the guide pin and also to slide along the axis of the tendon, but prevents movement transverse to the axis of the tendon.

Preferably, the guide pin comprises a shank of a predetermined length and diameter adjacent the tendon slide plate and an end cap with a second, larger width and a second predetermined length. The tendon alignment shoe preferably comprises a slot formed on its upper surface having a first opening sized to receive the second, larger diameter of the end cap, the slot formed sufficiently deep to allow the tendon alignment shoe to abut the tendon slide plate when the guide pin is inserted in the first opening. The slot further comprises an elongated undercut sized to receive the end cap and having a second elongated opening on the top surface of the tendon alignment shoe smaller than the second, larger diameter of the end cap.

The tendon alignment assembly of this invention may be used on pre-cast bridge beams, existing bridge beams, or any other beam or girder to increase its load bearing strength.

It is a further object of this invention to design an automatic aligning assembly that can be used on bridges having a road surface that can be skewed in any angle relative to the supports without modification.

It is another object of this invention to eliminate the wear of the tendon at the bearing surface due to cyclic and thermal movements by providing an assembly which can slide and rotate along with the tendon thereby increasing the durability of the tendon.

It is an additional object of this invention to eliminate the need for complex reinforcements on concrete bridge diaphragms and provide uniform pressure on the concrete bridge diaphragms.

It is another object of this invention to accommodate construction installation tolerances at both the pre-casters yard and at the construction site.

It is yet another object of this invention to provide for independent longitudinal and rotational movement between the tendons and the diaphragm.

It is yet another object of this invention to provide a tendon alignment assembly that allows for easy inspection and replace of worn parts.

It is still another object of this invention to provide for uniform bearing pressure around the tendon into the tendon alignment shoe and accommodates manufacturing irregularities of the tendon.

The present invention will become more fully understood from the detailed description below and the accompanying drawings.

BRIEF DESCRIPTION OF DRAWINGS

FIG. 4 is a longitudinal cross-sectional view of the tendon alignment assembly of the present invention;

FIG. 5 is a transverse cross-sectional view of the tendon alignment assembly of the present invention; and FIG. 6 is a planar cross-sectional view through the tendon alignment assembly of the present invention showing the slot and guide pin interaction.

BEST MODE FOR CARRYING OUT THE INVENTION

Figure 1:
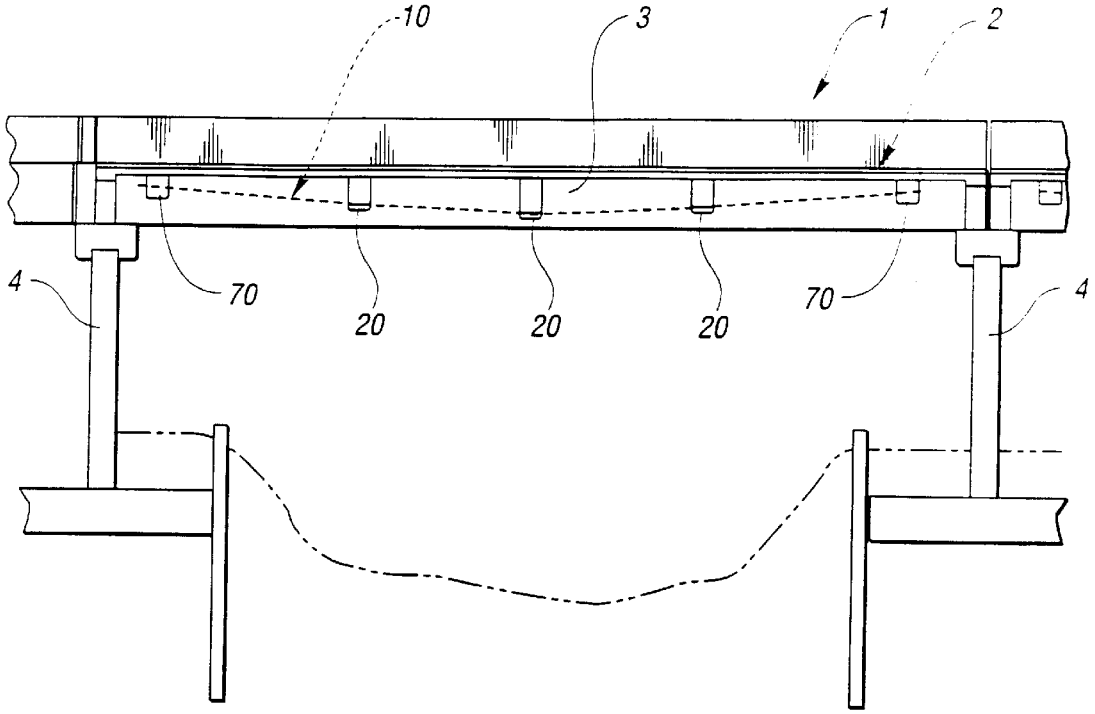
FIG. 1 is a longitudinal side view of one section of a bridge having the tendon alignment assembly of the present invention for aligning a tendon.

FIG. 1 depicts a longitudinal side view of a weight bearing structure, such as bridge 1 having road surface 2, the structure embodying the tendon alignment assembly 20 (shown in FIGS. 4 and 5) of the present invention. Bridge beam 3 is supported proximate its ends by supports 4. Tendon 10 is deployed along the underside of bridge beam 3 and anchored at each end by nut 12. Standard post-tensioning anchorage devices 70 (illustrated more fully in FIG. 3) available, for example, from Simplex as model number No. RC1003, a single-acting hollow core cylinder jack with a 91 metric ton capacity, tension tendon 10. In the illustrated example, the bridge span is connected to additional spans on each side of the structure, although the entire bridge may compose a single span. Supports 4 proximate the ends of the span are illustrated as pier-like supports, though the particular type of support is not material to this invention. In the preferred embodiment, bridge beams 3 are pre-cast off site and transported to the construction site. Tendon alignment assemblies 20 may also be installed on bridges manufactured out of concrete cast on site, wood, steel, or other materials.

There are three tendon alignment assemblies 20 in FIG. 1 and two post-tensioning anchorage devices 70 defining the catenary-like shape of each tendon 10. For optimal performance, tendon alignment assemblies 20 must be oriented on various planes to provide a specific catenary shape depending on the construction of tendon 10 and the size of the bridge structure.

Tendons 10 are post-tensioned after bridge beams 3 are in place using post-tensioning anchorage devices 70. Post-tensioning tendons 10 create compressive forces in the longitudinal direction on bridge beam 3 which increases its load bearing ability without greatly increasing its mass or size.

Figure 2:
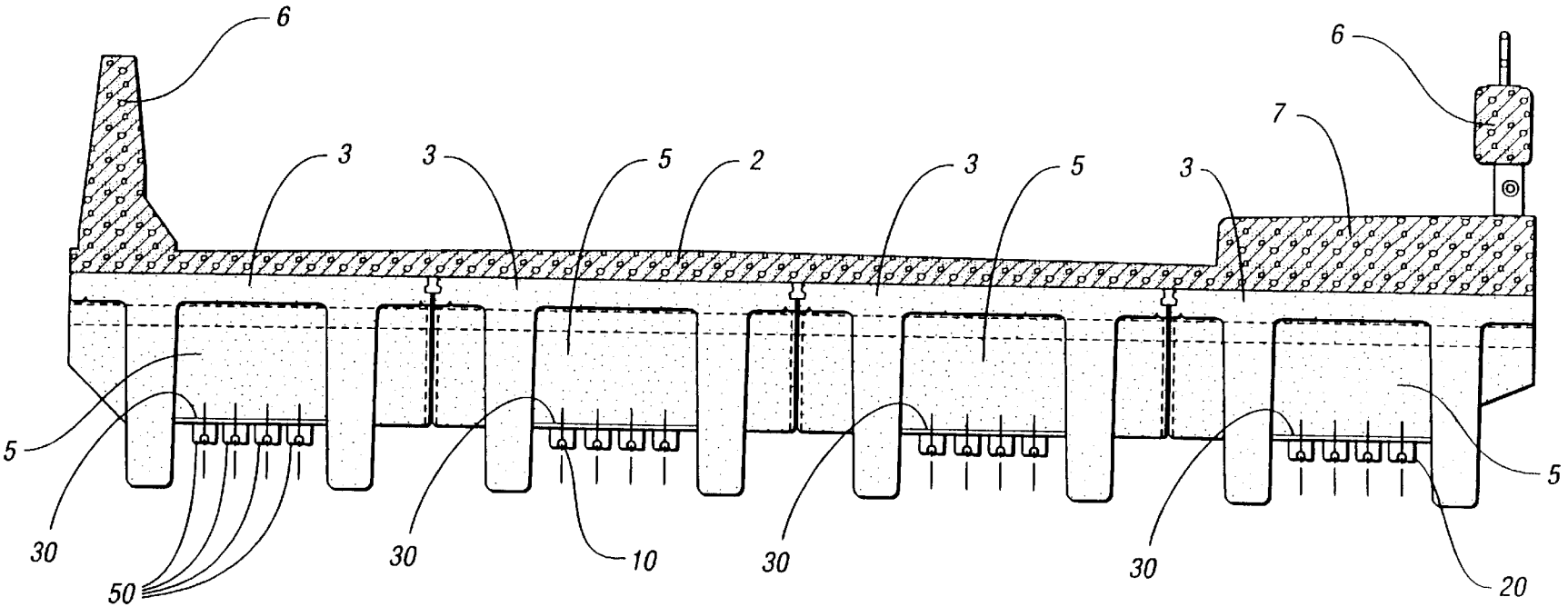
FIG. 2 is a transverse cross-sectional view of the bridge of FIG. 1 through the tendon alignment assemblies.

FIG. 2 depicts a transverse cross-sectional view of bridge 1 illustrated in FIG. 1. In this particular figure, road surface 2 is illustrated as a having edge guards 6 and a pedestrian path 7, though the particular type of road surface is not material to this invention. Each bridge span may comprise of several individual bridge beams 3 placed and fixed adjacent to each other using known means such as a standard post-tensioned rod or cable. Conversely, the complete transverse section may comprise of a single bridge beam. Under appropriate circumstances, the tendon alignment assembly of the present invention may also be used transversely across a bridge beam.

The tendon alignment assembly 20 (see, FIGS. 4–6) comprises tendon slide plate 30 and a tendon alignment shoe 50. FIG. 2 depicts tendon alignment plate 30 as extending across a substantial part of diaphragm 5 and encompassing all tendon alignment shoes 50. This allows for easier installation of the tendon slide plates 30. However, each individual tendon alignment shoe may have its own individually attached tendon slide plate 30.

Figure 3:
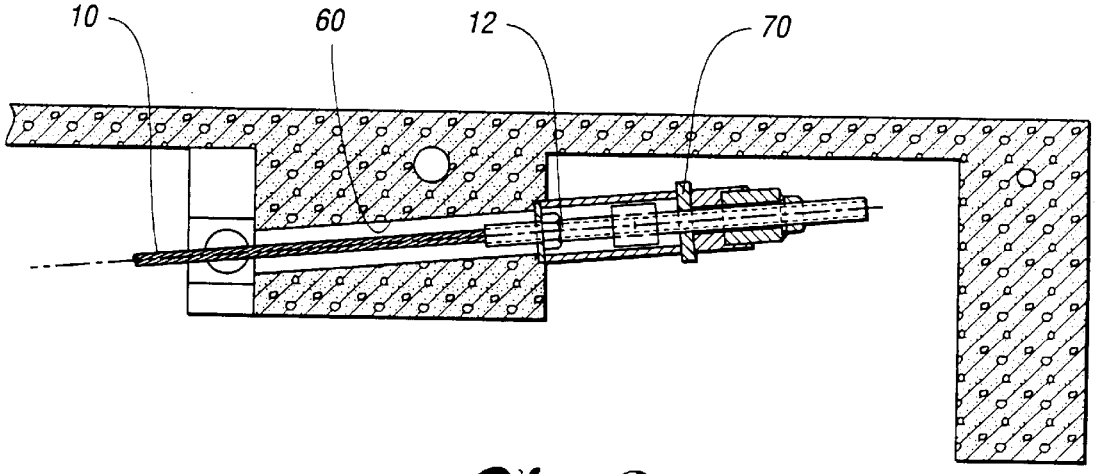
FIG. 3 is a cross-sectional view of a post-tensioning end anchorage device.

Tendon 10 may be manufactured out of steel, carbon fiber, or any other material of sufficient tensile strength and durability. The preferred embodiment uses a carbon fiber tendon available from Tokyo Rope in Japan having a diameter of approximately 40 mm. The carbon fiber tendon comprises a plurality of individual strands spiral wrapped and covered with a split conduit tubing to further protect the carbon fiber from the environment or abrasion. As shown in FIG. 3, the preferred embodiment of tendon 10 also utilizes a nut 12 which is received in post tensioning anchorage device 70 through bore 60 in bridge beam 3 proximate the ends of the beam. Once bridge beam 3 and tendon alignment assembly 20 are in place, post tensioning anchorage device 70 tensions tendon 10 to the appropriate tension, thereby increasing the load bearing capacity of the bridge. Post tensioning anchorage device 70 may then be removed. Other means of post tensioning tendon 10 may be used without deviating from this invention.

Referring now to FIGS. 4 and 5, the tendon alignment assembly 20 is shown in detail. The tendon slide plate 30 has a top surface 31 and a bottom surface 33. In the preferred embodiment, tendon slide plate 30 is integrally attached to the concrete bridge diaphragm 5 using headed weld studs 32 during the pre-casting operation of bridge beam 3. In the preferred embodiment, 12 mm×150 mm headed weld studs are used, though the number and size of headed weld studs 32 may vary depending on the particular application. Tendon slide plate 30 may also be attached to the concrete diaphragms, or metal bridge components, using screws, bolts, adhesive, welds, or other attachment means. It is important that the tendon slide plate be attached to the concrete diaphragm, but the exact means is not material to this invention. In the preferred embodiment, tendon slide plate 30 is manufactured out of annealed and hot finished type 304 ASTM A-276 stainless steel. Other materials capable of withstanding the mechanical stresses and the exposed environment may also be used. The bottom surface should preferably be polished to a bright mirror finish to allow tendon alignment shoe 50 to easily slide and rotate relative to tendon slide plate 30.

Guide pin 34 (see also, FIG. 6) extends down from the bottom surface 33 of tendon slide plate 30. Guide pin 34 comprises a shank 35 of a predetermined length and width or diameter adjacent the tendon slide plate 30 and an end cap or end piece 36 of a second predetermined length and width or diameter. In the preferred embodiment, guide pin 34 is machined out of a single piece of type 304 ASTM A-276 stainless steel and is then inserted and welded into a sized bore in the tendon slide plate 30. However, guide pin 34 may be machined or cast as part of tendon slide plate 30 or may comprise separate shank and end cap components attached together. Additionally, guide pin 34 may be fixed to tendon slide plate 30 using other known methods such as bolting it in place or a simple press fit. Guide pin 34 may also be manufactured out of other materials.

In the preferred embodiment, the diameter of end cap 36 is approximately 22 mm and the overall length of shank 35 and end cap 36 is approximately 41 mm.

Although illustrated as cylindrically shaped, guide pin 34 may be configured in other shapes, such as triangular, square, or octagonal in cross section, for example, and still allow tendon alignment shoe 50 to slide and rotate relative to tendon slide plate 30.

Tendon alignment shoe 50 has a top surface 51, which is in sliding and rotating engagement with the bottom surface 33 of the tendon slide plate, and a bottom surface 52, which defines a cavity 54 sized to receive tendon 10. The figures depict cavity 54 as a groove; however, cavity 54 may also be a bore through tendon alignment shoe 50 or may comprise of an additional piece of material clamped over the groove to make a bore-like aperture. Depending on the particular construction of tendon 10, cavity 54 may be required to arced along its longitudinal length, as shown in FIG. 4, to prevent any localized stress concentrations in tendon 10. The specific arc of each tendon alignment shoe 50 will depend on the overall length of tendon 10, the construction of tendon 10, and the catenary-like shape of tendon 10.

Tendon alignment shoe 50 comprises a slot 56 formed in its top surface 51 as best shown in FIG. 6. Slot 56 comprises a first opening 57 sized to receive end cap 36 of guide pin 34. The depth of the slot is designed such that when guide pin 34 is inserted into first opening 57, the top surface 51 of the tendon alignment shoe 50 abuts the bottom surface 33 of the tendon slide plate 30 as shown in FIG. 4. Slot 56 further comprises an elongated undercut 58 sized to receive end cap 36 and an elongated opening 59 smaller than the diameter of end cap 36 and larger than the diameter of shank 35 on the top surface 51 of tendon alignment shoe 50.

To install tendon alignment shoe 50 onto tendon slide plate 30, first opening 57 of tendon alignment shoe 50 is aligned with guide pin 34. Tendon alignment shoe 50 is then positioned such that guide pin 34 is in first opening 57 and then tendon alignment shoe 50 is maneuvered so that end cap 36 is slid into undercut 58 thereby allowing tendon alignment shoe 50 to rotate about guide pin 34 and also to slide, along the length of slot 56.

Other variations of the guide pin arrangement are possible. For example, guide pin 34 may be manufactured without end cap 36. Tendon alignment shoe 50 will still be able to rotate and slide relative to tendon alignment plate 30, but the tendon alignment shoe 50 will not stay on tendon alignment plate 30 on its own. Additionally, tendon alignment plate may comprise two guide pins 34, with or without end caps 36, that would allow tendon alignment shoe 50 to slide, but not rotate, relative to tendon slide plate 30. Further, tendon alignment shoe 50 may be manufactured without elongated undercut 58 which would allow tendon alignment shoe 50 to rotate, but not slide, relative tendon slide plate 30.

Preferably, a low friction pad 62, such as a Teflon® pad, is placed between bottom surface 33 of tendon slide plate 30 and top surface 51 of tendon alignment shoe 50 to allow tendon alignment shoe 50 to slide and rotate easier therefore increasing the effectiveness of the aligning and stress reducing capabilities of the assembly. More preferably, low friction pad 62 is attached to top surface 51 of tendon alignment shoe 50 using adhesive, bolts, or other means. Additionally, the depth of first opening 57 and undercut 58 may have to be adjusted to accommodate the added material.

Additionally, the preferred embodiment comprises a protective sheath 65 of an elastomeric material, such as neoprene or Nitrile®, placed around cavity 54 to reduce stress that may damage tendon 10 and assist tendon 10 to grip tendon alignment shoe 50 so that tendon 10 and alignment shoe 50 slide and rotate together. However, tendon 10 may be depoloyed such that tendon 10 slides relative to tendon alignment shoe 50 also. Protective sheath 65 may be bonded or otherwise fixed in place.

In operation, a pre-cast bridge beam comprising a pair of post-tensioning end anchorage devices proximate the ends of the pre-cast bridge beam is positioned onto supports 4 which may be perpendicular to the pre-cast bridge beam or skewed. Tendon alignment assembly 20 may be attached to the bridge beams 3 in the longitudinal direction or in the transverse direction. Tendon 10 is deployed along the underside of the pre-cast bridge beam, each end of tendon 10 attached to one of the post-tensioning anchorage devices 70. Tendon 10 is then positioned in at least one tendon alignment assembly 20. Tendon 10 is then post-tensioned using post-tensioning anchorage devices 70 to increase the load carrying capacity of the beam.

During dynamic loading, for example from bridge traffic, thermal expansion, wind conditions, or shifting of the ground, pre-cast bridge beam 3 may bend, flex, or otherwise change shape. The tensioned tendons 10 minimize deflections or stresses in pre-cast bridge beams 3 and assist the beams to return to their normal state. During dynamic loading conditions, tendon alignment shoe 50 can slide or rotate (about guide pin 34) relative to tendon slide plate 30 and pre-cast bridge beams 3 thereby eliminating any concentrated stress in tendon 10 that might result from tendon 10 not being perfectly concentric with the center-line of the tendon.

Additionally, tendon alignment shoes 50 may slide in the direction of the tendon to keep the tension throughout the whole tendon 10 the same rather than have varying tensions in tendon 10 between the tendon/beam contact points. Since tendon alignment shoe 50 slides and rotates, and will not move transversely, with tendon 10 during dynamic loading, tendon 10 will not wear due to friction. Tendon alignment shoe 50 also provides a larger bearing surface for tendon 10. Tendon slide plate 30 further provides an even larger uniform bearing surface thereby distributing the vertical force of tendon 10 into a larger area minimizing the chance for a localized failure in diaphragm 5.

Tendon alignment assemblies also compensate for irregularities in the construction of tendon 10, pre-cast bridge beams 3, or in the construction of the completed bridge by automatically aligning tendons 10 through the sliding and rotating of tendon alignment shoe 50.

Because tendon 10 and tendon alignment assemble 20 are in plain view, and each tendon 10 and tendon alignment shoe 50 is independent of the other tendons 10 and tendon alignment shoes, tendon 10 and tendon alignment assemble 20 can be inspected for wear and individually repaired or replaced if required. To replace tendon 10, tendon 10 is released from tension and removed from post-tensioning anchorage device 70 and replaced. The new tendon 10 is aligned in tendon alignment shoes 50 and post-tensioned to the desired tension. Components of tendon alignment assembly can be replaced by releasing tendon 10 from tension and removing tendon 10 from cavity 54 at which point tendon alignment assembly 20 may be worked on.

Although this invention was described in relation to a bridge, tendon alignment assembly 20 may be used to increase the load bearing ability of any beam, girder, or weight bearing structure.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A tendon alignment assembly for aligning and providing a bearing surface for externally exposed tendons below a weight bearing structure comprising:

a tendon slide plate having a top and bottom surface, the top surface being attachable to the underside of a structure; and a tendon alignment shoe having a top and bottom surface, the top surface of the tendon alignment shoe being in sliding and rotational engagement with the bottom surface of the tendon slide plate, wherein the bottom surface of the tendon alignment shoe defines a cavity for receiving a tendon.

2. The assembly of claim 1 further comprising a low friction pad placed between the bottom surface of the tendon slide plate and the top surface of the tendon alignment shoe.

3. The assembly of claim 2 wherein the low friction pad is attached to the top of the tendon alignment shoe.

4. The assembly of claim 1 wherein the tendon slide plate comprises a guide pin extending from the bottom surface of the tendon slide plate and the tendon alignment shoe further defines a slot on its upper surface sized to receive the guide pin, wherein the guide pin allows the tendon alignment shoe to slide with the tendon and prevents the tendon alignment shoe from sliding in the direction transverse to the tendon.

5. The assembly of claim 1 wherein the tendon slide plate comprises a guide pin extending from the bottom surface of the tendon slide plate, the guide pin comprising a shank of a predetermined length and width adjacent the tendon slide plate and an end piece of a second, larger width and a second predetermined length; and the tendon alignment shoe comprises a slot formed in its top surface, the slot having a first opening sized to receive the second, larger width of the end piece and formed sufficiently deep to allow the tendon alignment shoe to abut the tendon slide plate when the guide pin is inserted into the first opening, the slot further comprising an elongated undercut sized to receive the end piece and having a second elongated opening on the top surface of the tendon alignment shoe smaller than the second, larger width of the end piece, wherein the guide pin allows the tendon alignment shoe to slide with the tendon and rotate about the axis of the guide pin and prevents the tendon alignment shoe from sliding in a direction transverse to the tendon.

6. The assembly of claim 1 wherein the tendon slide plate comprises a guide pin extending from the bottom surface of the tendon slide plate, the guide pin comprising a cylindrical shank of a predetermined length and diameter adjacent the tendon slide plate and an end cap of a second, larger diameter and a second predetermined length; and the tendon alignment shoe comprises a slot formed in its top surface, the slot having a first opening sized to receive the second, larger diameter of the end cap and formed sufficiently deep to allow the tendon alignment shoe to abut the tendon slide plate when the guide pin is inserted into the first opening, the slot further comprising an elongated undercut sized to receive the end cap and having a second elongated opening on the top surface of the tendon alignment shoe smaller than the second, larger diameter of the end cap, wherein the guide pin allows the tendon alignment shoe to slide with the tendon and rotate about the axis of the guide pin and prevents the tendon alignment shoe from sliding in a direction transverse to the tendon.

7. The assembly of claim 6 wherein a low friction pad is placed between the bottom surface of the tendon slide plate and the top surface of the tendon alignment shoe and the slot is cut sufficiently deep to allow the tendon slide plate, the low friction material pad, and the tendon alignment shoe to abut each other.

8. The assembly of claim 7 wherein the low friction pad is attached to the top of the tendon alignment shoe.

9. The assembly of claim 8 further comprising an elastomeric protective sheathing attached in the tendon alignment shoe cavity before the tendon is received therein.

10. A bridge having at least one precast bridge beam, the bridge comprising:

at least one tendon deployed along the underside of the bridge beam, each end of the tendon secured by a post-tensioning end anchorage device attached proximate each end of the precast bridge beam; and at least one tendon alignment assembly attached between the ends of the precast bridge beam, the tendon alignment assembly comprising a tendon slide plate having a top and bottom surface, the top surface being rigidly fixed to the underside of the bridge beam; and a tendon alignment shoe having a top and bottom surface, the top surface of the tendon slide plate being in sliding and rotational engagement with the bottom surface of the tendon slide plate, wherein the bottom surface of the tendon alignment shoe defines a cavity for receiving a tendon.

11. The bridge of claim 10 wherein the tendon slide plate comprises a guide pin extending from the bottom surface of the tendon slide plate, the guide pin comprising a cylindrical shank of a predetermined length and diameter adjacent the tendon slide plate and an end cap of a second, larger diameter and a second predetermined length; and the tendon alignment shoe comprises a slot formed in its top surface, the slot having a first opening sized to receive the second, larger diameter of the end cap and formed sufficiently deep to allow the tendon alignment shoe to abut the tendon slide plate when the guide pin is inserted into the first opening, the slot further comprising an elongated undercut sized to receive the end cap and having a second elongated opening on the top surface of the tendon alignment shoe smaller than the second, larger diameter of the end cap, wherein the guide pin allows the tendon alignment shoe to slide with the tendon and rotate about the axis of the guide pin and prevents the tendon alignment shoe from sliding in a direction transverse to the tendon.

12. The bridge of claim 11 wherein a low friction pad is placed between the bottom surface of the tendon slide plate and the top surface of the tendon alignment shoe and the slot is cut sufficiently deep to allow the tendon slide plate, the low friction material pad, and the tendon alignment shoe to abut each other.

13. A load bearing road surface having at least one longitudinal support beam, the surface comprising:

a pair of post-tensioning end anchorage devices attached proximate the ends of the longitudinal support beam;

at least one tendon deployed underneath the surface, each end of the tendon attached to a post-tensioning end anchor use device, and at least one tendon alignment assembly attached between the ends of the longitudinal support beam, the tendon alignment assembly comprising:

a tendon slide plate having a top and bottom surface, the top surface being rigidly attached to the underside of the longitudinal support beam; and a tendon alignment shoe having a top and bottom surface, the top surface of the tendon alignment shoe being in sliding and rotational engagement with the bottom surface of the tendon slide plate, wherein the bottom surface of the tendon alignment shoe defines a cavity for receiving the tendon.

14. The load bearing road surface of claim 13 wherein the tendon slide plate comprises a guide pin extending from the bottom surface of the tendon slide plate, the guide pin comprising a cylindrical shank of a predetermined length and diameter adjacent the tendon slide plate and an end cap of a second, larger diameter and a second predetermined length; and the tendon alignment shoe comprises a slot formed in its top surface, the slot having a first opening sized to receive the second, larger diameter of the end cap and formed sufficiently deep to allow the tendon alignment shoe to abut the tendon slide plate when the guide pin is inserted into the first opening, the slot further comprising an elongated undercut sized to receive the end cap and having a second elongated opening on the top surface of the tendon alignment shoe smaller than the second, larger diameter of the end cap, wherein the guide pin allows the tendon alignment shoe to slide with the tendon and rotate about the axis of the guide pin and prevents the tendon alignment shoe from sliding in a direction transverse to the tendon.

15. A method for externally reinforcing a load bearing beam comprising the steps of:

rigidly attaching a pair of post-tensioning end anchorage devices proximate the ends of the load bearing beam;

deploying a tendon along the underside of the load bearing beam, each end of the tendon attached one of the post-tensioning anchorage devices;

positioning the tendon in at least one tendon aligning assembly, the tendon aligning assembly comprising:

a tendon slide plate having a top and bottom surface, the top surface being rigidly fixed to the underside of the load bearing beam; and a tendon alignment shoe having a top and bottom surface, the top surface of the tendon slide plate being in sliding and rotational engagement with the bottom surface of the tendon slide plate;

wherein the bottom surface of the tendon alignment shoe defines a cavity for receiving a tendon; and post-tensioning the tendon.

16. The method of claim 15 wherein the tendon slide plate comprises a guide pin extending from the bottom surface of the tendon slide plate and the tendon alignment shoe further defines a slot on its upper surface sized to receive the guide pin, wherein the guide pin allows the tendon alignment shoe to slide with the tendon and prevents sliding in the direction transverse to the tendon.

17. The method of claim 15 wherein the tendon slide plate comprises a guide pin extending from the bottom surface of the tendon slide plate, the guide pin comprising a cylindrical shank of a predetermined length and diameter adjacent the tendon slide plate and an end cap of a second, larger diameter and a second predetermined length; and the tendon alignment shoe comprises a slot formed in its top surface, the slot having a first opening sized to receive the second, larger diameter of the end cap and formed sufficiently deep to allow the tendon alignment shoe to abut the tendon slide plate when the guide pin is inserted into the first opening, the slot further comprising an elongated undercut sized to receive the end cap and having a second elongated opening on the top surface of the tendon alignment shoe smaller than the second, larger diameter of the end cap, wherein the guide pin allows the tendon alignment shoe to slide with the tendon and rotate about the axis of the guide pin and prevents the tendon alignment shoe from sliding in a direction transverse to the tendon.

* * * * *